US006298826B1

(12) United States Patent
Cotton, III

(10) Patent No.: US 6,298,826 B1
(45) Date of Patent: Oct. 9, 2001

(54) CONTROL VALVE WITH INTERNAL FLOW PATH AND FUEL INJECTOR USING SAME

(75) Inventor: Clifford E. Cotton, III, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/465,731

(22) Filed: Dec. 17, 1999

(51) Int. Cl.[7] ..... F02M 51/00
(52) U.S. Cl. ..... 123/446; 137/625.69; 239/95
(58) Field of Search ..... 123/446; 137/625.69; 239/88, 89, 90, 95

(56) References Cited

U.S. PATENT DOCUMENTS

| | | | | |
|---|---|---|---|---|
| 2,977,984 | | 4/1961 | Barnes . | |
| 3,405,906 | | 10/1968 | Keller . | |
| 4,116,591 | | 9/1978 | Mardell . | |
| 4,399,793 | | 8/1983 | Poore et al. . | |
| 4,489,698 | | 12/1984 | Höfer et al. . | |
| 4,544,096 | | 10/1985 | Burnett . | |
| 4,585,030 | | 4/1986 | Fox . | |
| 4,660,523 | | 4/1987 | Brauer et al. . | |
| 4,674,461 | | 6/1987 | Hiyama et al. . | |
| 4,753,212 | | 6/1988 | Miyaki et al. . | |
| 5,143,291 | * | 9/1992 | Grinsteiner | 123/446 |
| 5,339,777 | | 8/1994 | Cannon . | |
| 5,343,845 | | 9/1994 | Fehlmann . | |
| 5,423,302 | | 6/1995 | Glassey . | |
| 5,479,901 | * | 1/1996 | Gibson et al. | 123/472 |
| 5,507,316 | * | 4/1996 | Meyer | 137/625.65 |
| 5,669,355 | | 9/1997 | Gibson et al. . | |
| 5,682,858 | | 11/1997 | Chen et al. . | |
| 5,687,693 | | 11/1997 | Chen et al. . | |
| 5,720,318 | | 2/1998 | Nagarajan et al. . | |
| 5,737,238 | * | 4/1998 | Shorey et al. | 123/506 |
| 5,934,245 | | 10/1999 | Miller et al. . | |
| 5,957,106 | | 9/1999 | Maloney et al. . | |
| 6,047,899 | * | 4/2000 | Graves | 239/90 |
| 6,174,219 | * | 1/2001 | Mathews | 451/8 |

FOREIGN PATENT DOCUMENTS

| | | |
|---|---|---|
| 26 02 844 | 8/1977 | (DE) . |
| 1 328 959 | 9/1973 | (GB) . |

* cited by examiner

*Primary Examiner*—Andrew M. Dolinar
*Assistant Examiner*—Arnold Castro
(74) *Attorney, Agent, or Firm*—Liell & McNeil

(57) ABSTRACT

A control valve comprises a valve body that defines a high pressure passage, a low pressure passage and a flow passage. A valve member that is positioned in the valve body and defines an internal passage that opens through an end, and a closing hydraulic surface that is exposed to fluid pressure in the flow passage. The valve member is movable between a first position at which said high pressure passage is open to the flow passage via the internal passage and a second position at which the low pressure passage is open to the flow passage. The closing hydraulic surface is oriented such that pressure applied to the closing hydraulic surface produces a force on the valve member in a direction toward the second position.

20 Claims, 2 Drawing Sheets

CONTROL VALVE WITH INTERNAL FLOW PATH AND FUEL INJECTOR USING SAME

TECHNICAL FIELD

The present invention relates generally to control valves, and more particularly to use of center feed control valves in hydraulically actuated devices, such as fuel injectors.

BACKGROUND ART

A number of hydraulically actuated fuel injectors have been developed in recent years. While these injectors have performed well, engineers are always looking for ways to improve upon their design. For instance, because it is desirable to have an abrupt end to injection events with a lessened possibility of secondary injections, methods to more quickly relieve internal pressure after an injection event are often being sought. Additionally, a reduction in the overall size of the hydraulically actuated fuel injector is desirable to allow for incorporation of hydraulically actuated fuel injectors in ever smaller engine designs. Finally, it is almost always desirable to reduce the number of components in a hydraulically actuated fuel injector.

The present invention is directed to overcoming one or more of the problems set forth above.

SUMMARY OF THE INVENTION

A control valve comprises a valve body that defines a high pressure passage, a low pressure passage and a flow passage. A valve member is positioned in the valve body, has an end, and defines an internal passage that opens through the end. The valve member also defines a closing hydraulic surface that is exposed to fluid pressure in the flow passage. The valve member is movable between a first position at which the high pressure passage is open to the flow passage via the internal passage and a second position at which the low pressure passage is open to the flow passage. The closing hydraulic surface is oriented such that pressure applied to the closing hydraulic surface produces a force on the valve member in a direction toward the second position.

BEST MODE OF CARRYING OUT THE INVENTION

Figure 1:
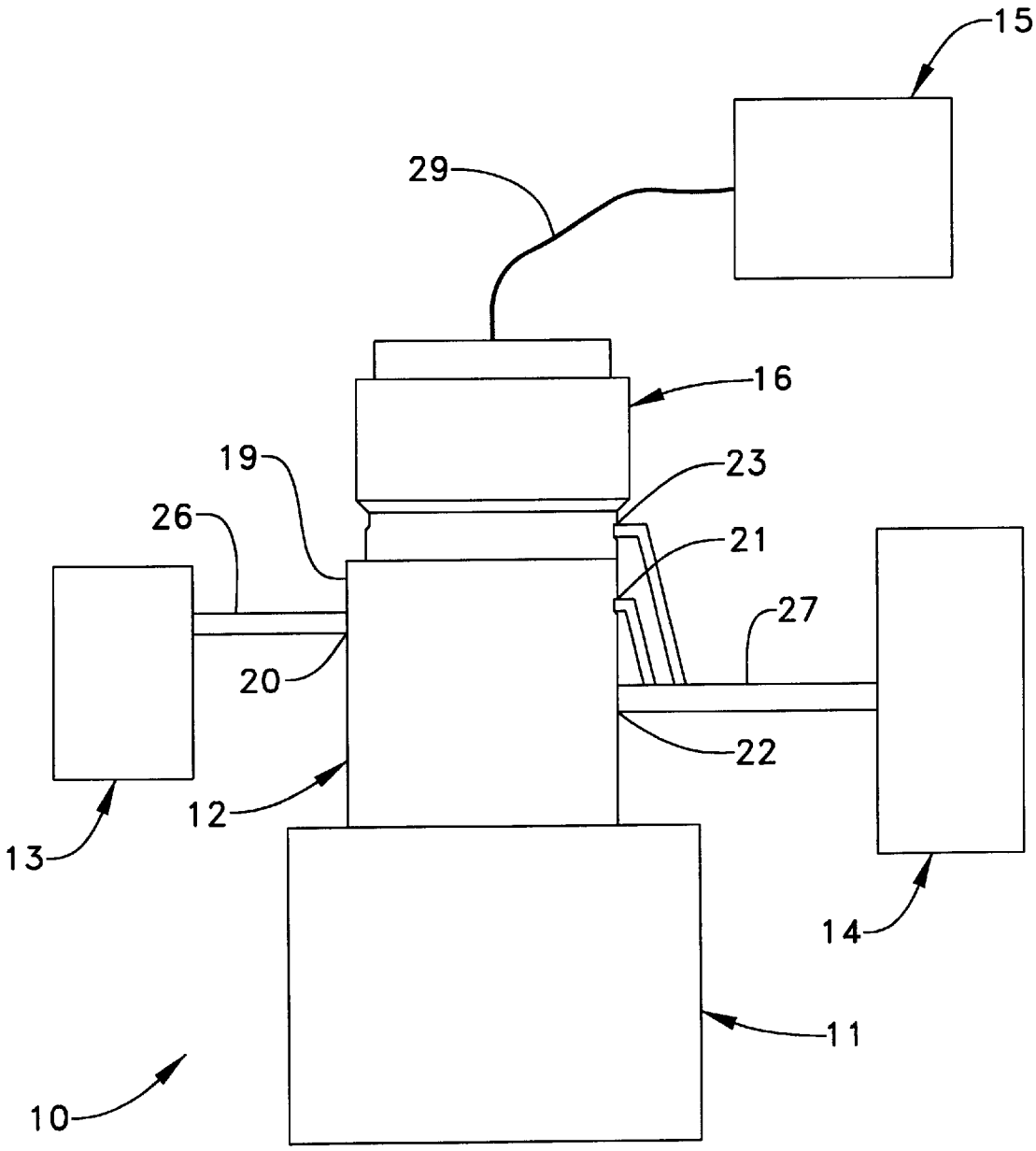
FIG. 1 is a schematic illustration of a hydraulic system that includes a hydraulically-actuated device according to the present invention.

Referring now to FIG. 1, hydraulic system 10 includes a hydraulically-actuated device 11, such as a fuel injector or an engine valve. A control valve 12 alternately opens hydraulically-actuated device 11 to a source of high pressure fluid 13 or a low pressure fluid reservoir 14. The state of control valve 12 is controlled by energizing and de-energizing an electrical actuating device 16, which is preferably a solenoid but could also be another suitable device such as a piezoelectric actuator. Electrical actuating device 16 is controlled in its operation by a conventional electronic control module 15 via communication line 29.

Control valve 12 includes a valve body 19 that defines a high pressure inlet 20 that is connected to the source of high pressure fluid 13 via a high pressure supply line 26. In this embodiment, valve body 19 also defines a low pressure vent 21 and a low pressure drain 22. These two low pressure openings communicate with low pressure fluid reservoir 14 via a low pressure passage 27. An armature cavity vent 23 is also included to channel actuating fluid that finds its way into electrical activating device 16 back to reservoir 14.

Figure 2:
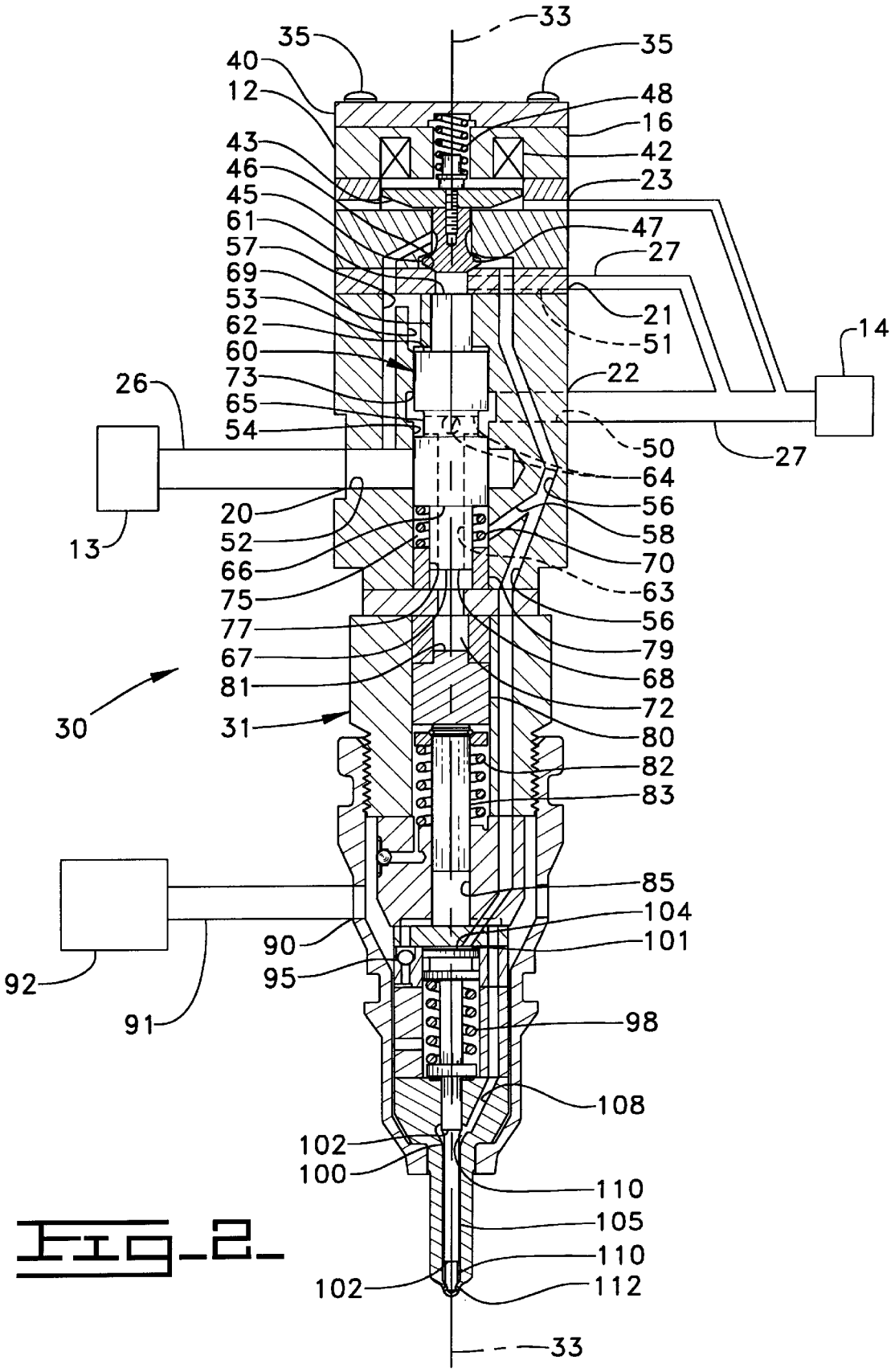
FIG. 2 is a diagrammatic front sectioned view of a hydraulically actuated fuel injector according to the present invention.

Referring now to FIG. 2 there is shown a diagrammatic representation of a hydraulically actuated fuel injector 30 according to the present invention. Fuel injector 30 includes an injector body 31 made up of various components that are attached to one another in a manner well known in the art and positioned as they would be just prior to an injection event. Actuation fluid can flow into a high pressure actuation fluid passage 52 that is defined by injector body 31 via an actuation fluid inlet 20 and high pressure supply line 26 from the source of high pressure fluid 13. At the end of an injection event, actuation fluid can flow out of a low pressure passage 50 that is defined by injector body 31 via an actuation fluid drain 22 into low pressure fluid reservoir 14. Injector body 31 also defines a low pressure passage 51 that is in constant fluid communication with low pressure vent 21. While a number of different fluids could be used as actuation fluid, the present invention preferably utilizes engine lubricating oil.

Fuel injector 30 is controlled in operation by a control valve 12 that includes an electrical actuator 16 which is preferably a solenoid 40, but could also be another suitable device such as a piezoelectric actuator. Control valve 12 is positioned in injector body 31 and attached by fasteners 35, which are preferably bolts but could be another suitable attachment device. Solenoid 40 includes a coil 42 and an armature 43 that is attached to a pilot valve member 45. Pilot valve member 45 is moveable within injector body 31 between a first position in which it closes a high pressure seat 47 and a second position in which it closes a low pressure seat 46. Injector body 31 also defines a variable pressure passage 56 that opens into the space between low pressure seat 46 and high pressure seat 47. Prior to an injection event, when solenoid 40 is de-energized, pilot valve member 45 is biased by a spring 48 to close low pressure seat 46 which opens variable pressure passage 56 to fluid communication with high pressure actuation fluid passage 52 via high pressure passage 57. When solenoid 40 is energized, armature 43 moves pilot valve member 45 upward to close high pressure seat 47, which closes variable pressure passage 56 to high pressure actuation fluid passage 52 and fluidly connects it to low pressure passage 51.

A center feed valve member 60 is positioned within fuel injector 30 and includes a number of surfaces that are exposed to fluid pressure in variable pressure passage 56, high pressure actuation fluid passage 57 and low pressure passage 51. While valve member 60 has been illustrated as a spool valve member, it should be appreciated that another valve member, such as a poppet valve, could be substituted. Valve member 60 is movable between a first, retracted position and a second, advanced position, and is biased to the second, upward position by a biasing spring 70 that is positioned within a spring chamber 75, which is in fluid communication with variable pressure passage 56 via branch passage 58. Spring chamber 75 is defined by valve member 60 and injector body 31. Valve member 60 includes a control pressure surface 66 that is exposed to fluid pressure in spring chamber 75. Valve member 60 also includes a low pressure surface 61 that is continuously exposed to low pressure from low pressure vent 21 via low pressure passage 51. Valve member 60 also includes a high pressure surface 62 that is continuously exposed to high pressure in high pressure passage 53 via high pressure passage 57, high pressure actuation fluid passage 52 and actuation fluid inlet 20. An internal passage 63 is defined by valve member 60 and opens through an end 67 into an actuation fluid cavity 72. End 67 is a portion of a closing hydraulic surface 68 exposed to fluid pressure within actuation fluid cavity 72. Closing hydraulic surface 68 is preferably oriented such that a pressure applied to this surface will produce a force on valve member 60 toward the upward, biased position. Therefore, at the end of an injection event, when pressure in actuation fluid cavity 72 is high, the fluid pressure within actuation fluid cavity 72 creates a hydraulic boost that helps move valve member 60 toward its upward position.

This feature of the present invention helps to eliminate secondary injections without the need for an additional valve member and/or additional plumbing. As an illustration, there are situations when needle valve member 105 closes nozzle outlet 112 while piston 80 and plunger 83 are still moving downward. This abrupt closure of nozzle outlet 112 can lead to an abrupt pressure increase in actuation fluid cavity 72, termed a pressure spike in the art. One previous injector, the subject of U.S. Pat. No. 5,682,858 to Chen et al., included a pressure spike valve and a pressure relief passage that would open the actuation fluid cavity to an additional drain at the end of an injection event. This introduction of an additional drain would help prevent the pressure acting on the opening hydraulic surface of the needle valve member from once again achieving a valve opening pressure and lifting the needle valve member for a secondary injection. However, by creating a hydraulic boost to quickly move valve member 60 to open actuation fluid cavity 72 to low pressure passage 50, the present invention can relieve the pressure on a needle valve member 105 more quickly by reducing pressure in actuation fluid cavity 72 without the need for additional components. In this manner, the present invention can increase the efficiency of fuel injector 30 while decreasing the number of components included in injector body 31.

Returning now to valve member 60, it also defines at least one radial passage 64 that fluidly connects internal passage 63 to an annulus 65 that is included on valve member 60. When valve member 60 is in the upward, biased position, annulus 65 opens internal passage 63 to low pressure passage 50. In this position, actuation fluid in actuation fluid cavity 72 can drain into low pressure reservoir 14 via actuation fluid drain 22. When valve member 60 is in the downward position, annulus 65 opens internal passage 63 to high pressure actuation passage 52, thereby allowing high pressure actuation fluid to flow through flow passage 54 and enter actuation fluid cavity 72 via internal passage 63. It should be appreciated that because valve member 60 preferably moves such a small distance, on the order of microns, annulus 65 should be sized just slightly larger than the distance between high pressure actuation passage 52 and low pressure passage 50 to allow one or the other to be opened to flow passage 54 during the positioning of valve member 60.

As illustrated in FIG. 2, the various surfaces of valve member 60 are sized and positioned to allow valve member 60 to be hydraulically balanced when solenoid 40 is de-energized. For instance, low pressure surface 61 has an effective area that is about equal in size to oppositely oriented closing hydraulic surface 68. Similarly, high pressure surface 62 is oriented opposite control pressure surface 66 and has an effective area that is about equal to that of control pressure surface 66. Because of this symmetry and orientation, when high pressure is acting on both control pressure surface 66 and high pressure surface 62, as when solenoid 40 is de-energized, valve member 60 is hydraulically balanced and biased to its first retracted upward position only by biasing spring 70. While it is preferable to size the various surfaces of valve 60 such that it is hydraulically balanced, it should be appreciated that these surface areas could be unequal and valve member 60 would still perform adequately.

For instance, a change in the areas of the various surfaces of valve member 60 might be desirable in order to eliminate the need for biasing spring 70. If the effective area of control pressure surface 66 was increased to much greater than that of high pressure surface 62, valve member 60 would no longer be hydraulically balanced when solenoid 40 is de-energized. Given these geometric characteristics, prior to an injection event, high pressure in spring chamber 75 would prevail and valve member 60 would be hydraulically biased toward the upward position, thus creating a hydraulic biasing force and eliminating the need for biasing spring 70. Thus, the present invention contemplates both hydraulic and mechanical biasers.

Returning now to valve member 60, it is guided in a lower guide bore 77 defined by a sleeve 79. An upper clearance area 73 is located between valve member 60 and injector body 31 above annulus 65. It should be appreciated that upper clearance area 73 should be relatively tight to allow valve member 60 to perform as desired and to ensure continuous fluid isolation of low pressure surface 61 and high pressure surface 62.

Returning now to fuel injector 30, injector body 31 also includes a reciprocating pumping element, piston 80, which can move between an upward position, as shown, and a downward advanced position. Piston 80 is biased toward its upward position by a return spring 82. Connected to piston 80 is a plunger 83. While piston 80, plunger 83 and valve member 60 have been shown sharing a common centerline 33, it should be appreciated that this is not necessary. As with piston 80, plunger 83 is biased toward its upward position by return spring 82. Piston 80 advances due to the hydraulic pressure force exerted on a hydraulic surface 81 which is exposed to fluid pressure in actuation fluid cavity 72. When piston 80 begins to advance, plunger 83 advances in a corresponding fashion and acts as the hydraulic means for pressurizing fuel within a fuel pressurization chamber 85 that is connected to a fuel inlet 90 past a ball check valve 95. Fuel inlet 90 is connected to a source of fuel 92 via a fuel supply passage 91. When plunger 83 is returning to its upward position, fuel is drawn into fuel pressurization chamber 85 past check valve 95. During an injection event as plunger 83 moves toward its downward position, check valve 95 is closed and plunger 83 can act to compress fuel within fuel pressurization chamber 85. Fuel pressurization chamber 85 is fluidly connected to a nozzle outlet 112 via a nozzle supply passage 108.

A direct control needle valve 100 is positioned in injector body 31 and includes a needle valve member 105 that is movable between a first position, in which nozzle outlet 112 is open, and a downward second position in which nozzle outlet 112 is blocked. Needle valve member 105 is mechanically biased toward its downward closed position by a biasing spring 98. Needle valve member 105 includes opening hydraulic surfaces 102 that are exposed to fluid pressure within a nozzle chamber 110 and a closing hydraulic surface 104 that is exposed to fluid pressure within a needle control chamber 101. As illustrated in FIG. 2, needle control chamber 101 is in fluid communication with variable pressure passage 56. Therefore, closing hydraulic surface 104 is exposed to high pressure passage 52 when solenoid 40 is de-energized and pilot valve member 45 is positioned to close low pressure seat 46. Similarly, closing hydraulic surface 104 is exposed to low pressure passage 51 when solenoid 40 is energized and pilot valve member 45 is closing high pressure seat 47.

Closing hydraulic surface 104 and opening hydraulic surfaces 102 are sized such that even when a valve opening pressure is attained in nozzle chamber 110, needle valve member 105 will not move against the action of biasing spring 98 when needle control chamber 101 is exposed to high pressure in variable pressure passage 56. In a similar manner, once solenoid 40 is de-energized at the end of an injection event, the high pressure in needle control chamber 101 will act to quickly move needle valve member 105 to close nozzle outlet 112 and end the injection event. Additionally, because closing hydraulic surface 104 has a larger effective area than opening hydraulic surfaces 102, once solenoid 40 is de-energized, the high pressure acting on closing hydraulic surface 104 will prevent needle valve member 105 from re-opening nozzle outlet 112 and injecting additional fuel into the combustion space. However, it should be appreciated that the relative sizes of closing hydraulic surface 104 and opening hydraulic surfaces 102 and the strength of biasing spring 98 should be such that when closing hydraulic surface 104 is exposed to low pressure in variable pressure passage 56, the high pressure acting on opening hydraulic surfaces 102 should be sufficient to move needle valve member upward against the force of biasing spring 98 to open nozzle outlet 112.

INDUSTRIAL APPLICABILITY

Prior to the start of an injection event, low pressure in fuel pressurization chamber 85 prevails, plunger 83 is in its retracted position, pilot valve member 45 is positioned to close low pressure seat 46 and needle valve member 105 is in its biased position closing nozzle outlet 112. Spring chamber 75 is in fluid communication with high pressure actuation fluid passage 52 via variable pressure passage 56 and actuation fluid cavity 72 is in fluid communication with low pressure passage 50 via internal passage 63 and radial passages 64. Valve member 60 is hydraulically balanced and biased toward its upward position by biasing spring 70. Recall that when valve member 60 is in this position, closing hydraulic surface 67 is exposed to low pressure in low pressure passage 51 via internal passage 63, radial passages 64 and annulus 65. The injection event is initiated by activation of solenoid 40, which causes armature 43 to lift pilot valve member 45 to close high pressure seat 47.

When pilot valve member 45 closes high pressure seat 47, variable pressure passage 56 becomes fluidly connected to low pressure passage 50. This causes a dramatic drop in pressure in both spring chamber 75 and in needle control chamber 101. The drop in pressure in spring chamber 75 results in a hydraulic imbalance of the pressures acting on valve member 60. Because low pressure is now acting on low pressure surface 61, control pressure surface 66, and closing hydraulic surface 67, the high pressure acting on high pressure surface 62 is sufficient to move valve member 60 downward against the action of biasing spring 70. As valve member 60 advances, annulus 65 moves out of contact with low pressure passage 50 and into contact with high pressure actuation fluid passage 52. This movement allows high pressure actuation fluid to flow into flow passage 54 through radial passages 64 and internal passage 63 and into actuation fluid cavity 72.

When actuation fluid cavity 72 becomes fluidly connected to high pressure actuation fluid passage 52, the high pressure acting on hydraulic surface 81 causes piston 80 to move downward against the action of biasing spring 82. This downward movement of piston 81 results in a corresponding downward movement of plunger 83. The downward movement of plunger 83 closes check valve 95 and raises the pressure of the fuel within fuel pressurization chamber 85, nozzle supply passage 108 and nozzle chamber 110. Recall that low pressure is acting on closing hydraulic surface 104 because needle control chamber 101 is fluidly connected to low pressure passage 51 via variable pressure passage 56. The increasing pressure of the fuel within nozzle chamber 110 acts on opening hydraulic surfaces 102 of needle valve member 105. When the pressure exerted on opening hydraulic surfaces 102 exceeds a valve opening pressure, needle valve member 105 is lifted against the action of biasing spring 98, and fuel is allowed to spray into the combustion chamber from nozzle outlet 112.

In addition to these singular injections, the present invention can be used to create split injections without the need for additional components. The mass properties and other engineering factors, such as the strength of spring 70, of valve member 60 cause it to react to the de-activation of solenoid 40 much slower than pilot valve member 45 or needle valve member 105. If a split injection is desired, this sluggish nature can be exploited to produce such an injection. For instance, at the end of the first portion of the split injection, solenoid 40 would be de-energized, causing pilot valve member 45 to quickly open high pressure seat 47 under the force of high pressure liquid in high pressure passage 52. Once high pressure seat 47 is opened, variable pressure passage 56 would be fluidly connected to high pressure inlet 20, and would begin to deliver high pressure fluid to needle control chamber 101. This high pressure acting on closing hydraulic surface 104 would abruptly close needle valve member 105 to end the first portion of the injection. In the meantime, valve member 60 would begin it's sluggish movement toward its biased position under the action of biasing spring 70. However, before valve member 60 could advance far enough to close actuation fluid cavity 72 to high pressure passage 52 via internal passage 63, solenoid 40 could again be energized causing pilot valve member 45 to open variable pressure passage 56 to low pressure passage 50. Because valve member 60 reacted slower than pilot valve member 45 and needle valve member 105, pressure in actuation fluid cavity 72 was never relieved, and needle valve member 105 could open with fuel pressure at a substantially higher pressure than valve opening pressure to create an abrupt beginning, or square injection or the second portion of the split injection. Thus, the present invention allows for more versatile use of fuel injector 30 without the need for additional components and passageways.

Returning to the injection event, shortly before the desired amount of fuel has been injected into the combustion space, current to solenoid 40 is ended to end the injection event. Solenoid 40 is de-energized and pilot valve member 45 moves under the action of spring 48 to close low pressure seat 46 which in turn closes variable pressure passage 56 from fluid communication with low pressure passage 51, and fluidly connects it to high pressure passage 52. Variable pressure passage 56 now delivers high pressure actuation fluid to both spring chamber 75 and needle control chamber 101. The high pressure within needle control chamber 101 acts on closing hydraulic surface 104 and causes needle valve member 105 to move to its downward, closed position to close nozzle outlet 112. Also, because high pressure is now acting on control pressure surface 66 and end surface 68, valve member 60 starts moving toward its biased, upward position under the action of biasing spring 70 and the hydraulic pressure acting on end surface 68. Recall that because of the high pressure in actuation fluid cavity 72, valve member 60 is given a hydraulic boost toward the upward, biased position.

As valve member 60 moves toward its upward position, but prior to the opening of low pressure passage 50 by annulus 65, piston 80 and plunger 83 stop their downward decent. Once annulus 65 moves out of contact with high pressure actuation fluid passage 52 and opens radial passages 64 to low pressure passage 50, flow passage 54 and actuation fluid cavity 72 are open to low pressure passage 50 and low pressure drain 22 via internal passage 63. Because hydraulic surface 81 is now exposed to low pressure in actuation fluid cavity 72, piston 80 and plunger 83 are allowed to move toward their upward, biased positions under the action of biasing spring 82. This upward movement of plunger 83 relieves the pressure on fuel within fuel pressurization chamber 85 and causes a corresponding drop in pressure nozzle supply passage 108 and nozzle chamber 110.

Between injection events various components of injector body 31 begin to reset themselves in preparation for the next injection event. Because the pressure acting on piston 80 and plunger 83 has dropped, return spring 82 moves piston 80 and plunger 83 back to their retracted positions. The retracting movement of plunger 83 causes fuel from fuel inlet 90 to be pulled into fuel pressurization chamber 85 via fuel supply passage 91.

The present invention reorganizes the various passageways in a fuel injector to allow the injector package to be reduced in both length and diameter. This is accomplished both by the movement of certain passageways toward the center of the injector and by the elimination of various valve components such as the pressure relief valve of the Chen injector. This elimination of components not only allows the injector to be reduced in size, but also reduces that number of parts that inherently increase complexity and reduce reliability of the fuel injector. The present invention also reduces the likelihood of secondary injections by creating a hydraulic boost that acts to hasten the closure of the valve member at the end of the injection event. Finally, because the high pressure passage is much closer to the center of the fuel injector, there is more room available for assembling hydraulically actuated fuel injectors with conventional fasteners, such as bolts.

It should be understood that the above description is intended for illustrative purposes only, and is not intended to limit the scope of the present invention in any way. For instance, while the pilot valve, spool valve and reciprocating piston have all been illustrated as having a common centerline, this need not be the case. Further, while the present invention has been described utilizing a hydraulically balanced spool valve, it should be appreciated that the spool valve does not need to be hydraulically balanced. Additionally, it should be appreciated that while the valve member of the present invention has been illustrated using a top hat, the present invention could perform adequately without this feature. Thus, those skilled in the art will appreciate the various modifications could be made to the disclosed embodiments without departing from the intended scope of the present invention, which is defined in terms of the claims set forth below.

What is claimed is:

1. A control valve comprising:

a valve body defining a high pressure passage, a low pressure passage and a flow passage;

a valve member positioned in said valve body and having an end and defining an internal passage that opens through said end, and including a closing hydraulic surface exposed to fluid pressure in said flow passage, and being movable between a first position at which said high pressure passage is open to said flow passage via said internal passage, and a second position at which said low pressure passage is open to said flow passage; and said closing hydraulic surface being oriented such that pressure applied to said closing hydraulic surface produces a force on said valve member in a direction toward said second position.

2. The control valve of claim 1 further comprising a biaser operably positioned in said valve body to bias said valve member toward said second position.

3. The control valve of claim 1 wherein said valve member includes a control pressure surface; and a pilot member positioned in said valve body and being movable between a first position at which said control pressure surface is exposed to pressure in said low pressure passage, and a second position at which said control pressure surface is exposed to pressure in said high pressure passage.

4. The control valve of claim 1 wherein said valve member is a spool valve member.

5. The control valve of claim 1 wherein said valve member includes a control pressure surface in opposition to a high pressure surface that is exposed to fluid pressure in said high pressure passage; and a spring compressed between said control pressure surface and said valve body.

6. The control valve of claim 5 further comprising a pilot member positioned in said valve body and being movable between a first position at which said control pressure surface is exposed to pressure in said low pressure passage, and a second position at which said control pressure surface is exposed to pressure in said high pressure passage.

7. A hydraulically actuated device comprising:

a valve body defining a high pressure passage, a low pressure passage and a flow passage;

a source of high pressure fluid connected to said high pressure passage;

a low pressure reservoir connected to said low pressure passage;

a reciprocating piston with a hydraulic surface exposed to fluid pressure in said flow passage;

a valve member positioned in said valve body and having an end and defining an internal passage that opens through said end, and including a closing hydraulic surface exposed to fluid pressure in said flow passage, and being movable between a first position at which said high pressure passage is open to said flow passage via said internal passage, and a second position at which said low pressure passage is open to said flow passage; and said closing hydraulic surface being oriented such that pressure applied to said closing hydraulic surface produces a force on said valve member in a direction toward said second position.

8. The hydraulically actuated device of claim 7 wherein said valve member includes a control pressure surface; and a pilot member positioned in said valve body and being movable between a first position at which said control pressure surface is exposed to pressure in said low pressure passage, and a second position at which said control pressure surface is exposed to pressure in said high pressure passage.

9. The hydraulically actuated device of claim 8 wherein said valve member includes a high pressure surface that is exposed to fluid pressure in said high pressure passage; and a biaser operably positioned in said valve body to bias said valve member toward one of said first position and said second position.

10. The hydraulically actuated device of claim 9 wherein said biaser includes a spring compressed between said valve member and said valve body; and said valve member is a spool valve member.

11. The hydraulically actuated device of claim 10 wherein said high pressure surface is oriented in opposition to said closing hydraulic surface and said control pressure surface.

12. The hydraulically actuated device of claim 11 wherein said high pressure surface has a first effective area; and said control pressure surface has a second effective area that is about equal to said first effective area.

13. The hydraulically actuated device of claim 12 wherein said valve member defines an annulus and at least one radial passage extending between said annulus and said internal passage.

14. The hydraulically actuated device of claim 13 wherein said valve member includes a low pressure surface exposed to fluid pressure in said low pressure passage.

15. A hydraulically actuated fuel injector comprising:

an injector body defining an actuation fluid inlet, an actuation fluid drain, an actuation fluid cavity and a nozzle outlet;

a valve member positioned in said injector body and having an end and defining an internal passage that opens through said end, and including a closing hydraulic surface exposed to fluid pressure in said actuation fluid cavity and a control pressure surface, and being movable between a first position at which said actuation fluid inlet is open to said actuation fluid cavity via said internal passage, and a second position at which said actuation fluid drain is open to said actuation fluid cavity;

said closing hydraulic surface being oriented such that pressure applied to said closing hydraulic surface produces a force on said valve member in a direction toward said second position a reciprocating pumping element positioned in said injector body and including a pumping hydraulic surface exposed to pressure in said actuation fluid cavity;

a pilot member positioned in said injector body and being movable between a first position at which said control pressure surface is exposed to pressure in actuation fluid drain, and a second position at which said control pressure surface is exposed to pressure in said actuation fluid inlet.

16. The hydraulically actuated fuel injector of claim 15 further comprising a direct control needle valve positioned in said injector body.

17. The hydraulically actuated fuel injector of claim 16 wherein said injector body defines a fuel inlet connected to a source of low pressure fuel; and said actuation fluid inlet is connected to a source of high pressure actuation fluid.

18. The hydraulically actuated fuel injector of claim 17 further comprising a spring compressed between said valve member and said injector body; and said valve member is a spool valve member.

19. The hydraulically actuated fuel injector of claim 18 wherein said valve member includes a high pressure surface exposed to fluid pressure in said actuation fluid inlet, and a low pressure surface exposed to fluid pressure in said actuation fluid drain;

said high pressure surface having a first effective area about equal in size, but oriented in opposition to said control pressure surface; and said low pressure surface having a second effective area about equal in size, but oriented in opposition to said closing hydraulic surface.

20. The hydraulically actuated fuel injector of claim 19 wherein said internal passage and said pumping element share a common centerline.

* * * * *